US005464661A

United States Patent [19]

Lein et al.

[11] Patent Number: 5,464,661

[45] Date of Patent: Nov. 7, 1995

[54] REDUCED SOLVENT ISLAND COATING SYSTEM

[75] Inventors: Maureen M. Lein, Chester; Gary F. Pelletier, Dover, both of N.H.; Jeffrey D. Goad, Barboursville; Chinsoo S. Lee, Charleston, both of W. Va.

[73] Assignee: Davidson Textron Inc., Dover, N.H.

[21] Appl. No.: 248,649

[22] Filed: May 25, 1994

[51] Int. Cl.[6] ..... B05D 1/02; B05D 1/36; B05D 7/14

[52] U.S. Cl. ..... 427/409; 427/412.1; 427/421

[58] Field of Search ..... 427/421, 422, 427/409, 412.1

[56] References Cited

U.S. PATENT DOCUMENTS

| | | | |
|---|---|---|---|
| 2,992,125 | 7/1961 | Fustier | 428/458 |
| 2,993,806 | 7/1961 | Fisher et al. | 117/71 |
| 3,118,781 | 1/1964 | Downing | 428/458 |
| 3,914,472 | 10/1975 | Nakanishi et al. | 428/416 |
| 4,101,698 | 7/1978 | Dunning et al. | 428/31 |
| 4,131,530 | 12/1978 | Blum et al. | 428/457 |
| 4,211,822 | 7/1980 | Kurfman et al. | 428/458 |
| 4,215,170 | 7/1980 | Oliva | 428/458 |
| 4,407,871 | 10/1983 | Eisfeller | 428/31 |
| 4,431,711 | 2/1984 | Eisfeller | 427/294 |
| 4,713,143 | 12/1987 | Eisfeller | 156/655 |
| 4,923,720 | 5/1990 | Lee et al. | 427/422 |
| 5,009,367 | 4/1991 | Nielsen | 239/3 |
| 5,027,742 | 7/1991 | Lee et al. | 427/422 |
| 5,057,342 | 10/1991 | Hoy et al. | 427/422 |
| 5,066,522 | 11/1991 | Cole et al. | 427/422 |
| 5,106,650 | 4/1992 | Hoy et al. | 427/483 |
| 5,108,799 | 4/1992 | Hoy et al. | 427/422 |
| 5,141,156 | 8/1992 | Hoy et al. | 239/135 |
| 5,171,613 | 12/1992 | Bok et al. | 427/422 |
| 5,178,325 | 1/1993 | Neilsen | 239/1 |
| 5,203,843 | 4/1993 | Hoy et al. | 239/135 |
| 5,211,342 | 5/1993 | Hoy et al. | 239/135 |
| 5,212,229 | 5/1993 | Taylor et al. | 524/556 |
| 5,290,625 | 3/1994 | Eisfeller et al. | 428/216 |
| 5,384,161 | 1/1995 | Eisfeller et al. | 427/421 |

OTHER PUBLICATIONS

Chopra, KL, *Thin Film Phenomena,* Robert E. Kreiger Publ. Co., Huntington, N.Y., pp. 163–189 (1979) No Month Available.

Maissel and Glang, *Handbook of Thin Film Technology,* McGraw–Hill, New York, N.Y., pp. 8–43 (1970) (No Month Available).

*Primary Examiner*—Diana Dudash

*Attorney, Agent, or Firm*—Reising, Ethington, Barnard & Perry

[57] ABSTRACT

A process for manufacturing a metallized part using the island coating method, including spray depositing a primer layer, basecoat layer, or combined primer/basecoat layer. Each layer contains an increased amount of film forming polymer by using liquid $CO_2$ as a supplemental carrier along with a reduced amount of organic solvent carrier thereby reducing waste disposal costs and environmental concerns. Further, this modified island coating system can be used to deposit layers of 1.5 to 2.0 mils thick and maintain the aesthetic properties of the metallizing island coating system at a reduced cost and with minimal variability among parts.

15 Claims, No Drawings

REDUCED SOLVENT ISLAND COATING SYSTEM

TECHNICAL FIELD

This invention pertains to vacuum deposition of amphoteric materials.

BACKGROUND OF THE INVENTION

Vacuum metallizing of plastic and similar dielectric substrates is disclosed in various forms including U.S. Pat. Nos.:

2,992,125 Fustier 2,993,806 Fisher 3,118,781 Downing 3,914,472 Nakanishi 4,101,698 Dunning 4,131,530 Blum 4,211,822 Kaufman 4,215,170 Oliva In addition, two reference books are:

*Thin Film. Phenomena,* Kasturi L. Chopra, Robert E. Kreiger Publishing Company, Huntington, N.Y., 1979. pp. 163–189.

*Handbook of Thin Film Technology,* Leon I. Maissel and Reinhard Glang, McGraw-Hill Book Company, New York, N.Y., 1970., pp. 8–32 to 8–43.

U.S. Pat. Nos. 4,407,871, 4,431,711 and 4,713,143, assigned to assignee of the present invention and incorporated herein by reference, relate to metallizing of plastic articles and more particularly to the structure and spacing of discrete metal islands used to metallize rather than a continuous metal film. The metallizing is performed utilizing the island coating system as detailed in the aforesaid patents. The system includes generally a primer and a basecoat coating layers, a metallizing layer and a topcoat layer. As disclosed in the above referenced patents, the coating layers contain non-volatile film forming polymers, generally in the range of 10–30%.

The most efficient way to deposit the coating layers of the island coating system is through a spray system. All of the coatings have been applied using a high volume, low pressure spray gun. However, such a system requires the use of organic solvents, generally at 70–90% by weight, as carriers for the coatings in order to be effectively deposited. If the mixture is not properly sprayed the aesthetic properties of the metallized appearance are not achieved. When the materials are sprayed, care must be taken to avoid gravitational flow of the material across the surface of the item being sprayed which can cause coating irregularities such as drips and runs. The material must be even, yet thick enough to cover surface irregularities and yet island formation must occur. Further, using this technology, film builds of 1.5 to 2.0 mils for any coating layer cannot be achieved without significant coating irregularities.

In addition to proper deposition of the coating layers, the appearance and performance of the commercial product, the conductivity of the metal layer, the corrosion resistance of the metal layer and/or the adhesion of the top coat all relate to the structure and spacing of the islands. The above referenced patents provide further teachings related to nucleation and film growth to the desired island structure and spacing that achieves these ends.

In U.S. Pat. No. 5,290,625, assigned to the assignee of the present invention and incorporated herein by reference, the above process is applied to aluminum parts. In a co-pending application, U.S. Ser. No. 248,957, pending, filed the same day as the instant application, assigned to the assignee of the present invention and incorporated herein by reference, the coating layers are modified to include a combined primer/basecoat layer.

U.S. Pat. No. 4,431,711 shows the significant difference in performance to be obtained with a vacuum metallized flexible plastic product, top coated, where the metal particles are coalesced only to the island state instead of being allowed to coalesce as a thin continuous metallic film across which electrical conductivity is established.

The substrate is prepared for metallization by application of primer and basecoat layers in a solvent. The metal is vacuum deposited on the prepared substrate and the separate islands are coalesced from separate nucleation points and are globular or rounded and fused appearing and are part of the nucleation and growth process. The deposited islands are formed, in a preferred embodiment, by indium which is amphoteric and thus has some solubility in both acids and bases. As deposited, the indium metal layer is composed of tiny islands ranging from tiny clusters of 25 angstroms or less in diameter to sizes as large as 4,000 angstroms in diameter. Each of the islands is separated by channels which can be several hundred angstroms wide which produces the desired electrically non-conductive characteristics across the surface of the substrate.

In general, the spaces between the coalesced islands can be filled with the resin of the top coating applied in a solvent, in effect encapsulating the islands and binding them to the substrate surface. The rounded islands are better protected by the resin and the film overall is far more corrosion resistant, surprisingly so. The metal film is much more securely adhered to the substrate—a very significant advantage.

The construction of the metal island structure in U.S. Pat. No. 4,431,711 includes islands that are separated by channels which receive the top coat and allow the resinous film of the top coat to bond to the substrate for the indium island structures. The channels formed between the individual islands also contain many clusters and smaller islands of residual material. This material reduces the total effective area of substrate material to which the top coat can be bonded. Consequently, the resultant vacuum metallized article may be subject to undesirable delamination between the top coat and the substrate material.

The '143 patent adds to the process the step of etching the vacuum deposited material with a solvent which slowly dissolves or removes residual amounts of metal from the channels between the distinct islands. This clears the channels exposing additional bonding surfaces on the substrate for increasing the surface area of adhesion between the substrate and a protective dielectric top coat.

The typical adhesion strength of a top coat material to a base coat material is in the range of two orders of magnitude stronger than the adhesion strength of the top coat to the metal making up the individual island structures separated by the channels. The etch treatment step greatly improves the adhesion of top coat material of the type set forth in U.S. Pat. No. 4,431,711.

While the flexible substrate described in U.S. Pat. No. 4,431,711 has sufficient adhesion to pass most automotive specification tests, it is desirable to improve the adhesion in such articles so that it will consistently pass an X-scribed type taped adhesion test after either Florida exposures or accelerated weathering tests including QUV, weatherometer, xenon, dual carbon arc weatherometer. With increasing emphasis on quality in American made cars, such tests are now part of automotive specifications. By etching the island containing metal layers of the type described in U.S. Pat. No. 4,431,711, an improved adhesion between top coat and base coat materials results so that such X-scribed standards can be met.

Weatherability now includes a requirement for resistance to acid rain. Acid rain is a low pH aqueous solution composed of several acids, primarily nitric and sulfuric acids. Rain drops which remain on the surface of the topcoat have the ability to permeate through the topcoat. As the droplets evaporate, the concentration of acid increases and is therefore more "aggressive". To improve resistance to acid rain, the thickness of the top coat must be increased, thereby reducing permeability. However, as the thickness of the top coat is increased flowout can become poor with its associated "orangepeel" appearance. Other coating irregularities such as drips and runs can occur. Further, "popping" and/or air entrapment increases and gives an appearance that does not provide the aesthetic properties of the metallized appearance.

The current island coating system applies the polymeric constituents of the primer layer, basecoat layer and topcoat layer in organic solvent carriers such as glycol ethers, glycolether acetates, aromatic hydrocarbons and dibasic esters. These solvent carriers pose a waste disposal problem increasing the cost of production significantly. If the organic solvents could be eliminated, while still maintaining the aesthetic properties of the metallized appearance, significant savings as well as ease of waste disposal would be attained.

U.S. Pat. No. 4,923,720 to Lee et al, issued May 8, 1990 and assigned to the Union Carbide Chemicals and Plastics Company, Inc. and incorporated herein by reference, presents a further detailed discussion in columns 1 and 2 on the problems inherent in the use of organic solvent carriers.

Liquid inorganic carriers such as $CO_2$ can be substituted for organic solvent carriers as disclosed in the Lee et al. '720 patent. In converting gaseous inorganic carriers to the liquid state either pressure or pressure combined with increased temperature can be used to create a "supercritical" fluid or dense gas in which is soluble in the polymer system. The utilization of pressure and increased temperature is expensive not only to produce but to maintain the gaseous inorganic carrier in a liquid state. If pressure alone is used to maintain such a liquid state, there is a further increase in temperature (Ideal Gas Law) that can adversely affect the stability of the polymeric constituents being carried by the liquified inorganic carrier. Additionally, as the pressurized polymeric material is circulated through the spray system, further instability can result.

The Lee et al. '720 patent and a series of related patents as listed below:

| U.S. Pat. No. | Date of Issue |
|---|---|
| 5,212,229 | May 18, 1993 |
| 5,211,342 | May 18, 1993 |
| 5,203,843 | April 20, 1993 |
| 5,178,325 | Jan. 12, 1993 |
| 5,171,613 | Dec. 15, 1992 |
| 5,141,156 | Aug. 25, 1992 |
| 5,108,799 | Apr. 28, 1992 |

-continued

| U.S. Pat. No. | Date of Issue |
|---|---|
| 5,106,650 | Apr. 21, 1992 |
| 5,066,522 | Nov. 19, 1991 |
| 5,057,342 | Oct. 15, 1991 |
| 5,027,742 | Jul. 2, 1991 |
| 5,009,367 | Apr. 23, 1991 |

provide information for a system for use of supercritical fluids as diluents in spray coating. The system as taught in the above patents is marketed by Union Carbide Corporation, Danbury, Conn., as UNICARB®System . Applicant has used the system, and modified the system as taught in the aforementioned patents, to meet the required specifications for parts metallized using the island coating system. There was a variability in appearance of the parts and the UNICARB® system solvent blend was expensive to use.

It would be useful to be able to use a non-organic or reduced organic solvent system such as the UNICARB® System to deliver the components of the island coating system producing uniform results at a reduced cost. Further, in utilizing such a system, it is necessary that coatings of 1.5–2.0 mils thickness be deposited without coating defects such as popping, drips, runs and sags.

SUMMARY OF THE INVENTION AND ADVANTAGES

According to the present invention, a process for manufacturing a metallized part using the island coating method, includes spray depositing a primer layer, basecoat layer, or a combined primer/basecoat layer each containing an increased amount of film forming polymer by using liquid $CO_2$ as a supplemental carrier along with a reduced amount of organic solvent carrier thereby reducing waste disposal costs and environmental concerns. Further, this modified island coating system can be used to deposit layers of 1.5 to 2.0 mils thick and maintain the aesthetic properties of the metallizing island coating system at a reduced cost and with minimal variability among parts.

DETAILED DESCRIPTION OF THE PREFERRED EMBODIMENT

The present invention provides a process of manufacturing parts that have a metallized appearance, that reduces the amount of organic wastes and allows the spray deposition of coatings, without coating irregularities of up to 2.0 mil thickness.

The part can be made from a substrate material selected from the group consisting of thermoplastic urethanes, thermoplastic urethane alloys, polyester alloys, thermoplastic olefins and aluminum.

The island coating system is then applied as taught in U.S. Pat. Nos. 4,407,871, 4,431,711 and 4,713,143 with the improvements disclosed in the present invention. In general, the island coating system includes generally either a combined primer/basecoat layer, or separate primer and basecoat layers, a metallizing layer and a topcoat layer. Each coating layer contains film forming polymers as disclosed in the above referenced patents.

In the practice of the present invention, the primer, basecoat and topcoat layers are applied using liquid $CO_2$ as a supplemental carrier along with a reduced amount of organic solvent blend carrier utilizing a noncirculating metering system which helps to maintain the stability of the components of each layer. In a preferred embodiment, a UNICARB® System is the source of the liquid $CO_2$ and airless spray technology is used to apply the coatings.

To accommodate the liquid $CO_2$ as a carrier and maintain stability, the coating layers consist of a reduced solvent content of 50–70%, with 64% being the preferred embodiment. The solvent blend is comprised of xylene (20–25%), glycol ether acetates (60–80%) and dibasic ester (3–10%). The non-volatile film forming polymer of the coatings is increased from 10–30% by weight to 30–50% to accommodate the liquid $CO_2$ as a carrier. The percentage of $CO_2$ is 15–20% with 17% as the preferred embodiment.

The solvent blend taught by the Lee et al '742 patent was found to be more expensive to use, even though a lower percentage was the recommended value. In the preferred embodiment of the present invention a cost savings of at least 10% in the cost of the solvent blend has been realized.

Neither the solvent blend percentage or $CO_2$ percentage are taught by the Lee et al '742 patent to be the preferred values. It was unexpected to find a combination of non-preferred values that provided the optimum results to maintain the metallized appearance. In fact as shown in Table 1, hereinbelow, $CO_2$ percentage in the preferred range of 20–60% as taught by the Lee et al '742 patent did not provide an acceptable appearance. The formulation had to balance evaporation rates and solubility of polymeric material solvents.

The coatings are applied using airless spray technology (Nordson) Corporation, Westlake, Ohio. The coatings are applied while the substrate is at ambient temperature.

The coatings are flashed for twenty minutes to evaporate the solvents in the coating followed by a curing step after application of each layer. Curing of each layer is done for 30 minutes at 260° F.

In a preferred embodiment, the step of spray depositing is done while the part is being rotated as described in the co-pending application U.S. Ser. No. 977,219, now U.S. Pat. No. 5,284,679 assigned to the assignee of the present invention, and incorporated herein by reference.

Certain parts may require the step of spray depositing to include spot sanding, or a full sanding, prior to application. In another embodiment, a further coating consisting of automotive exterior paint can be applied to the topcoat layer.

The resin and the solvent blend are mixed together and placed in a pressure pot for spraying. The coating and $CO_2$ are heated and then mixed with the resin-solvent blend mixture in a metered ratio just prior to spraying.

The invention will now be described by way of the following examples with it being understood that other advantages and a more complete understanding of the invention will be apparent to those skilled in the art from the detailed description of the invention.

EXAMPLE 1

The Lee et al '742 patent teaches a preferred range of organic solvent blend of from 5 to 50% (column 6, lines 56–61), ranging as high as 70% with $CO_2$ being at 20–60 wt %. Samples were prepared and evaluated first for appearance and when appearance was satisfactory for adhesion, weatherability, chip resistance and for other automotive specification. To meet appearance standards no orangepeel, runs, drips, sags, pinholes, popping, or other detrimental appearance defects could be present.

Optimal results were obtained when the solvent blend was reduced to 64%, and $CO_2$ (Table 1) was at 17%. Neither of these values are in the preferred range taught by the Lee et al '742 and other Union Carbide patents. It was unexpected to find a combination of non-preferred values that provided the optimum conditions to obtain the metallized appearance with the island coating system.

TABLE 1

| % CO | RESULTS |
|---|---|
| 12 | Poor flowout (orangepeel), popping |
| 13 | Poor flowout (orangepeel), popping |
| 14 | Poor flowout (orangepeel) |
| 15 | Marginally acceptable flowout (slight orange peel) |
| 16 | Good flowout |
| 17 | Good flowout |
| 18 | Good flowout |
| 19 | Good flowout |
| 20 | Good flowout |
| 21 | Acceptable flowout, some $CO_2$ entrapment which dissipates |
| 22 | $CO_2$ entrapment which causes some popping |

Using the above optimum system, in conjunction with airless spray technology (UNICARB® System metering/spray equipment by Nordson) Corporation, samples were evaluated at various film builds for a metallized appearance.

At all coating thicknesses tested from 1.5 to 2.0 mils coating thickness, the coatings of the present invention exhibited excellent flow and leveling with no evidence of popping. Further, these increased coating thicknesses appear to improve adhesion after weathering.

EXAMPLE 2

Permeability of the Topcoat

Acid rain resistance was measured as a function of moisture or water vapor permeability of the top coat layer.

METHOD

Permeability tests were conducted in accordance with ASTM D 1653, "Test Method for Water Vapor Transmission of Organic Coating Films", Method A (Dry cup). Water vapor transmission rate (WVT) is measured in grains/foot$^2$/hour. Permeance is measured in grains/foot$^2$/hour/inch of mercury (perms). A perm rating of $\leqq 1.0$ indicates a vapor barrier coating. A perm value of $>4.0$ indicates a permeable coating.

Two tests were performed. In the first test (A) two moisture cured urethane clearcoat films were tested at film builds of 1.0 and 2.0 mils. In a second test (B) six samples of 0.769, 1.442, 1.7, 2.1, 2.8, and 3.5 were tested.

RESULTS

| | 1.0 mils | 2.0 mils |
|---|---|---|
| Test A: | | |
| Water Vapor Transmission Rate WVT grains/square foot/hour | 4.35 | 1.02 |
| Permeance-Perms WVP grains/square foot/hour /inch of Mercury | 9.18 | 2.15 |

-continued

| RESULTS | | |
|---|---|---|
| | Test B: | |
| Mils | WVT | Perms |
| 0.769 | 2.97 | 6.95 |
| 1.442 | 1.17 | 2.74 |
| 1.70 | 1.01 | 2.37 |
| 2.10 | 0.78 | 1.83 |
| 2.80 | 0.68 | 1.52 |
| 3.50 | 0.58 | 1.30 |

CONCLUSION

Permeability decreases in a non-linear manner as topcoat thickness increases, becoming asymptotic to 1.3 perms at 3.3 mils thickness. It was unexpected to find that the permeability of the topcoat in the island coating system decreases in a non-linear manner as topcoat thickness increases. Thicker topcoats will therefore be more resistant to acid rain injury than would have been predicted.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. A process for manufacturing a metallized part comprising the steps of:

providing a part made from a material selected from the group consisting of thermoplastic urethanes, thermoplastic urethane alloys, polyester alloys, thermoplastic olefins and aluminum;

spray depositing a coating layer selected from the group consisting of a primer layer, basecoat layer and combined primer/basecoat layer, containing a film forming polymer at 30–50% by weight with an organic solvent carrier at 50–70% by weight initially and adding $CO_2$ as a supplemental carrier at 15–20% by weight;

vacuum depositing a layer of corrosion prone metal material to form a discontinuous film covering the basecoat layer including a plurality of discrete islands of the corrosion prone metal material appearing macroscopically as a continuous film of such metal and having a plurality of macroscopically unobservable channels between the islands to maintain the discontinuous film electrically non-conductive over the basecoat layer; and spray depositing a layer of clear resinous protective dielectric topcoat containing film forming polymer at 30–50% by weight with organic solvent carrier at 50–70% by weight initially and adding $CO_2$ as a supplemental carrier at 15–20% by weight to completely cover the layer of vacuum deposited corrosion prone metal material and filling the channels for bonding with the topcoat the corrosion prone metal material to the basecoat layer throughout a bottom of the channels by an adhesion force greater than two orders of magnitude in strength as compared to the strength of the adhesion force between the topcoat and a continuous layer of the corrosion prone metal material.

2. The process for manufacturing a metallized part as set forth in claim 1 wherein the primer, basecoat, combined primer/basecoat and topcoat layer have a thickness in the range of 0.8 mil to 2.5 mils and the thickness of each layer can be the same or different as any other layer.

3. The process for manufacturing a metallized part as set forth in claim 2 wherein the topcoat layer has a thickness of 2.0 mils.

4. The process for manufacturing a metallized part as set forth in claim 1 wherein the organic solvent carrier is 64% by weight.

5. A process for manufacturing an acid rain resistant metallized part comprising the steps of:

providing a part made from a material selected from the group consisting of thermoplastic urethanes, thermoplastic urethane alloys, polyester alloys, thermoplastic olefins and aluminum;

spray depositing a coating layer selected from the group consisting of a primer layer, basecoat layer and combined primer/basecoat layer, containing a film forming polymer at 30–50% by weight with an organic solvent carrier at 50–70% by weight initially and adding $CO_2$ as a supplemental carrier at 15–20% by weight;

vacuum depositing a layer of corrosion prone metal material to form a discontinuous film covering the basecoat layer including a plurality of discrete islands of a corrosion prone metal material appearing macroscopically as a continuous film of such metal and having a plurality of macroscopically unobservable channels between the islands to maintain the discontinuous film electrically non-conductive over the basecoat layer; and spray depositing a layer of clear resinous protective dielectric topcoat from 1.5 to 2.0 mils thick containing film forming polymer at 30–50% by weight with an organic solvent carrier at 50–70% by weight initially and adding $CO_2$ as a supplemental carrier at 15–20% by weight to completely cover the layer of vacuum deposited corrosion prone metal material and filling the channels with the topcoat for bonding the corrosion prone metal material to the basecoat layer throughout a bottom of the channels by an adhesion force greater than two orders of magnitude in strength as compared to the strength of the adhesion force between the topcoat and a continuous layer of the corrosion prone metal material.

6. The process for manufacturing a metallized part as set forth in claim 5 wherein the topcoat layer has a thickness of 2.0 mils.

7. A process for manufacturing a part comprising the steps of:

providing a part made from a material selected from the group consisting of thermoplastic urethanes, thermoplastic urethane alloys, polyester alloys, thermoplastic olefins and aluminum;

spray depositing a coating layer selected from the group consisting of a primer layer, basecoat layer and combined primer/basecoat layer, containing a film forming polymer at 30–50% by weight with an organic solvent carrier at 50–70% by weight initially and adding $CO_2$ as a supplemental carrier at 15–20% by weight; and spray depositing a layer of clear resinous protective topcoat containing film forming polymer at 30–50% using $CO_2$ as a supplemental carrier along with organic solvent carrier at 50–70% to completely cover the coating layer.

8. The process for manufacturing a part as set forth in claim 7 wherein the primer, basecoat, combined primer/basecoat and topcoat layer have a thickness in the range of 0.8 mil to 2.5 mils and the thickness of each layer can be the same or different as any other layer.

9. The process for manufacturing a part as set forth in claim 8 wherein the topcoat layer has a thickness of 2.0 mils.

10. The process for manufacturing a part as set forth in claim 7 wherein the organic solvent carrier is reduced to 50–70%.

11. The process for manufacturing a part as set forth in claim 10 wherein the organic solvent carrier is reduced to 64%.

12. The process for manufacturing a part as set forth in claim 7 wherein $CO_2$ as a supplemental carrier is at 15 to 20%.

13. The process for manufacturing a part as set forth in claim 7 wherein the film forming polymer is increased to 30 to 50%.

14. A process for manufacturing an acid rain resistant part comprising the steps of:

providing a part made from a material selected from the group consisting of thermoplastic urethanes, thermoplastic urethane alloys, polyester alloys, thermoplastic olefins and aluminum;

spray depositing a coating layer selected from the group consisting of a primer layer, basecoat layer and combined primer/basecoat layer, containing a film forming polymer at 30–50% by weight with an organic solvent carrier at 50–70% by weight initially and adding $CO_2$ as a supplemental carrier at 15–20% by weight; and spray depositing a layer of clear resinous protective topcoat from 1.5 to 2.0 mils thick containing film forming polymer at 30–50% by weight with an organic solvent carrier at 50–70% by weight initially and adding $CO_2$ as a supplemental carrier at 15–20% by weight to completely cover the coating layer.

15. The process for manufacturing a part as set forth in claim 14 wherein the topcoat layer has a thickness of 2.0 mils.

* * * * *